US006179505B1

(12) United States Patent
Oder, III et al.

(10) Patent No.: US 6,179,505 B1
(45) **Date of Patent: *Jan. 30, 2001**

(54) VENTING ROLL-ON APPLICATOR

(75) Inventors: Reuben Earl Oder, III, Union, KY (US); Richard Mark Baginski, Loveland, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/952,837

(22) PCT Filed: Jun. 20, 1995

(86) PCT No.: PCT/US95/07825

§ 371 Date: May 6, 1998

§ 102(e) Date: May 6, 1998

(87) PCT Pub. No.: WO96/37126

PCT Pub. Date: Nov. 28, 1996

(51) Int. Cl.[7] ..... B43K 23/08
(52) U.S. Cl. ..... 401/213; 401/217; 401/214
(58) Field of Search ..... 401/213, 214, 401/208, 210, 216, 217

(56) References Cited

U.S. PATENT DOCUMENTS

| | | | | |
|---|---|---|---|---|
| 3,095,598 | * | 7/1963 | Gonnella et al. | 401/214 |
| 3,336,626 | * | 8/1967 | Schaich | 401/214 |
| 3,560,100 | | 2/1971 | Spatz | 401/180 |
| 4,221,495 | | 9/1980 | Braun et al. | 401/213 |
| 5,810,495 | * | 9/1998 | McAuley | 401/213 |

FOREIGN PATENT DOCUMENTS

| | | |
|---|---|---|
| 4031484 A1 | 3/1991 | (DE) . |
| 0 303 275 A2 | 2/1989 | (EP) . |
| 2 215 673 | 9/1989 | (GB) . |

* cited by examiner

*Primary Examiner*—David J. Walczak
(74) *Attorney, Agent, or Firm*—Jack L. Oney, Jr.

(57) ABSTRACT

A roll-on applicator which allows venting of gases between the inside and the outside of said applicator. This applicator comprises a ball within a dispensing opening and a flexible and resilient support means for said ball. Said flexible and resilient support means is such to urge said ball against said dispensing opening, achieving a leak tight engagement between said ball and said dispensing opening. This engagement is such that the pressure built up inside said container is not efficiently released to the outside of said container. Furthermore, said flexible and resilient support means can be resiliently deformed by an external force acting on said ball to disengage said leak-tight engagement between said ball and said dispensing opening, allowing said contained product to be spread by said ball. Said applicator further comprises a cap which presses onto said ball creating a free passage between said ball and said dispensing opening only when said cap is engaged or disengaged from said container.

13 Claims, 7 Drawing Sheets

VENTING ROLL-ON APPLICATOR

FIELD OF THE INVENTION

The present invention relates to a roll-on applicator. The roll-on applicator according to the present invention allows venting of gasses between the interior and the exterior of said applicator.

BACKGROUND OF THE INVENTION

Roll-on applicators are well known in the art. Usually, said applicators are containers comprising a hollow body for liquids, a ball and a retaining support means for said ball. These roll-on applicators generally allow to apply a liquid film from the inside of the hollow body to a selected surface. The common problem of these is to avoid leakage or spillage of the contained liquid during the periods of non-use of said roll-on applicators. The prior art solves this problem using the cooperation of a cap. Indeed, as disclosed in U.S. Pat. No. 3,036,328, U.S. Pat. No. 4,221,494, U.S. Pat. No. 4,221,495, U.S. Pat. No. 4,475,837 and U.S. Pat. No. 5,051,017, the ball is forced to engage and bear against a sealing surface of said retaining support means when the container is closed by the cap. But this solution to avoid leakage or spillage is inconvenient, if the above retaining support means with the ball is located under the level of the content. Indeed, leakage or spillage may occur during the operation of unscrewing the cap. For this reason, the roll-on applicator of the prior art usually has the retaining support means for the ball only on top of the corresponding container above the level of the content when said container is stored in its upright position.

Another disadvantage of the roll-on applicators of the prior art is given by the fact that the spread quantity cannot be increased. Instead, the prior art only teaches a decrease of said spread quantity. Indeed, the roll-on applicating means described in the above mentioned prior art can force the ball to engage and bear against a sealing surface of said retaining support means to decrease or stop completely the flow of the content on said ball. The inverse is never possible. On the contrary, an increased spread quantity is useful especially during pretreatment of stains on a fabric. Indeed, different stains may need a greater amount of liquid detergent for a more effective pretreatment. For example, stains made of certain constituents may need a greater quantity of detergent to get a more thorough and effective pretreatment. A greater quantity may also be needed to simply cover the dimension of the stain itself.

The above problems have been solved by the roll-on applicator described in the co-pending European patent application 94870179.2. Said roll-on applicator comprises a container adapted to contain and dispense a product. Said container comprises a hollow body, a dispensing opening, a ball and a flexible and resilient support means for said ball. Said flexible and resilient support means urges said ball against said dispensing opening, achieving a leak-tight engagement between said ball and said dispensing opening. Said flexible and resilient support means can be deformed in a resilient manner by an external force acting on said ball whereby said leak-tight engagement between said ball and said dispensing opening is disengaged, allowing said contained product to be spread by said ball. In practice, said flexible and resilient support means together with said ball acts as a valve which opens when pressing on said ball.

We found that said ball urged against said dispensing opening by said flexible and resilient support means achieves also a gas-tight engagement. In the following, "gas-tight engagement" means that no gases are able to pass through the engagement between the inside and the outside of the container. Alternatively, "gas-tight engagement" may also mean that the rate of pressure which may be released to the outside of the container through this engagement (hereinafter called "pressure release rate") is smaller than the rate of pressure produced inside said container. Therefore, a pressure builds up inside said container, because the amount of gases which are able to escape to the outside of said container is too small in respect to the pressure built up inside said container.

There are a number of possible factors which may lead to the existence of the pressure built up inside said container. The content of the package may, for example, be chemically unstable or may be subject to reaction with gases which may exist in the head space of the package, or alternatively, in certain specific circumstances, may react with the package material itself. Any chemical reactions involving the liquid contents may lead to production of gases, and hence to overpressure in the package.

Pressure built up inside said container may also occur when the temperature during the filling and sealing of the container is significantly different from external temperature during shipment, transportation and storage. Another possibility of a pressure difference may be caused by a different ambient pressure at the filling of the container from another ambient pressure at a different geographical location.

We found that the gas-tightness between said ball and said opening is further increased, or the pressure release rate is further reduced, when the pressure builds up inside said container. Indeed, this internal pressure further presses said ball against said dispensing opening further reducing the pressure release rate. The pressure release rate may be reduced down to almost no pressure release at all.

We further found that product can be expelled outwards when pressure has been built up inside said roll-on applicator described in the co-pending European patent application 94870179.2. To apply the contained product around the ball, it may be necessary to invert said container to convey said product towards said ball. This is not necessary, if said ball together with said flexible and resilient support means are always located under the filling level of said product. Nevertheless, in both cases, when pressing on said ball a free passage between said ball and said dispensing opening is created. Therefore, the built-up gas inside said container tends immediately to escape through said free passage, like a burp. Consequently, product situated between said built-up gas and said free passage may be also expelled in a rapid and an uncontrolled manner. This product rapidly expelled creates messiness and waste. Indeed, the expelled product may cover also other areas which were not intended to be covered by the user. Furthermore, the quantity of product expelled may be greater than necessary without the possibility of control.

It is therefore an object of the present invention to provide a leak-tight container comprising a roll-on applicator, but which nevertheless allows venting of gases to impede that product may be expelled from the inside of said container driven by the pressure built up inside the container, thereby avoiding messiness and waste of the contained product.

SUMMARY OF THE INVENTION

The present invention is a package comprising a container (10) adapted to contain and dispense a product, and a cap (20). Said container comprises a hollow body (1), a dispensing opening (2), a ball (3) and a flexible and resilient support means (4) for said ball. Said flexible and resilient support means urges said ball against said dispensing opening, achieving a substantially leak-tight engagement between said ball and said dispensing opening. Said flexible and resilient support means can be deformed in a resilient manner by an external force acting on said ball whereby said substantially leak-tight engagement between said ball and said dispensing opening is disengaged, allowing said contained product to be spread by said ball. Said cap can be engaged to said container in a removable manner. Said cap covers said dispensing opening. Said cap presses onto said ball creating a free passage between said ball and said dispensing opening only when said cap is engaged and/or disengaged from said container.

DETAILED DESCRIPTION OF THE INVENTION

Figure 1A:
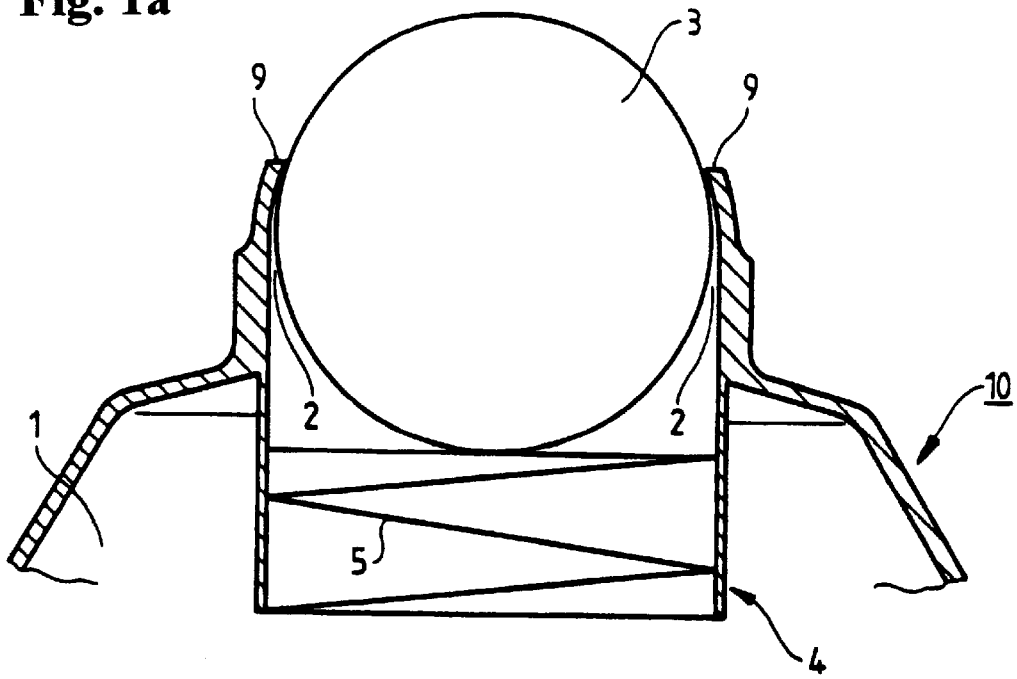
FIGS. 1*a* and 1*b* are cross sectional views showing a container (shown partially) with an embodiment of the flexible and resilient support means for a ball according to the present invention in a cross sectional view.
Figure 1B:
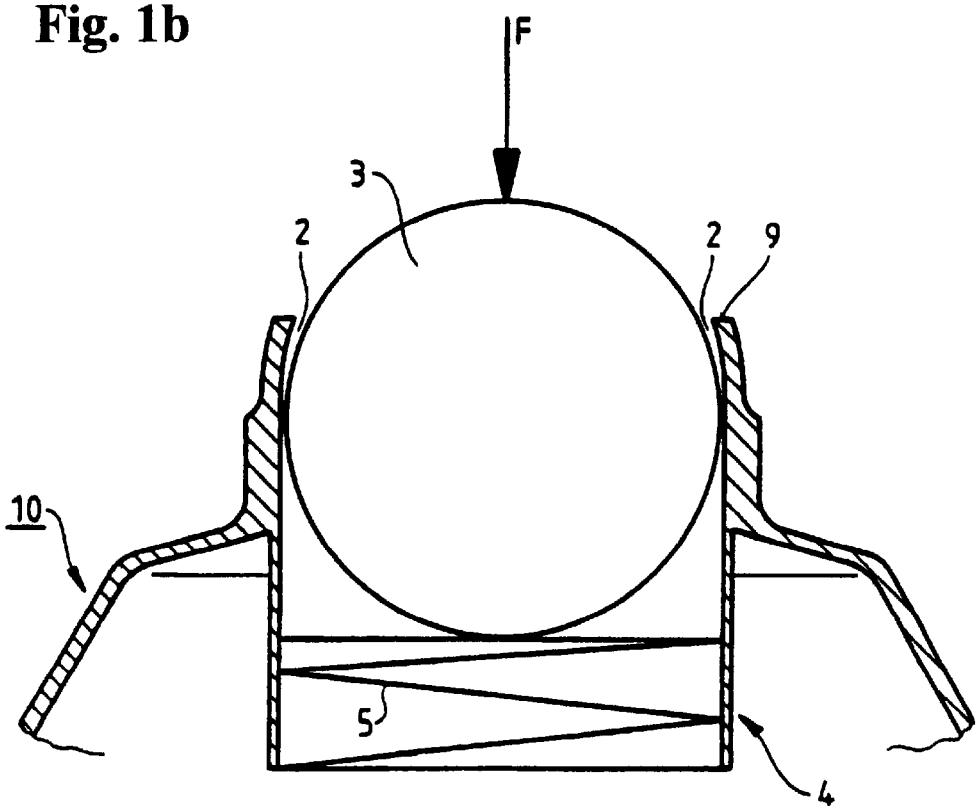

An embodiment of the container (10) according to the present invention is shown in a cross sectional view in FIG. 1*a* and 1*b*. The present invention provides a container (10) (only partially shown in FIG. 1*a*) adapted to contain and dispense a product. The word "container" encompasses any form and/or type of containers comprising a hollow body (1) and a dispensing opening (2). For example, bottles, tubes, dosing and/or dispensing devices are containers according to the definition of the present invention. The hollow body (1) of the container may be made of a rigid, soft or flexible material. Soft or flexible materials may be preferred to allow squeezing of the hollow body itself for a further controlled dispensing through the opening. Specifically for dosing and/or dispensing devices, said hollow body may be preferably made of a material resistant to water temperatures up to 95° C. Said dispensing opening is located in the upper portion of said container. In the following, "upper portion of said container" is the portion of said container from said dispensing opening down to the highest level of the contained product when said container stands on its upright position or it is the neck when said container is, for example, a bottle. Furthermore, the "axis of a container" is a direction perpendicular to the basis upon which said container stands in its upright position.

Specifically, said dosing and/or dispensing devices are adapted for pretreatment of fabrics, like, for example, the one described in WO 92/09736 and/or WO 92/09736. Usually, said dosing and/or dispensing device adapted for pretreatment comprises a further opening which allows the filling of this device. When this device is put inside the washing machine with the fabrics, said filling opening also allows the dispensing of the content into the wash liquid of the machine during the wash cycle. The filling opening is usually located on the top of said dosing and/or dispensing device when said device is in its upright position.

A partially or completely transparent hollow body (1) is a preferred option to allow the user to verify the quantity of the content and facilitate measuring and dosing with dosing and/or dispensing devices. As a further preferred option said container may have an upper portion which is inclined in respect to the rest of said hollow body, i.e. said dispensing opening is not along the axis of said container. In this manner, the tilting angle necessary to dispense said contained product through said dispensing opening can be reduced. As another preferred option, said hollow body may further comprise at least one dosing line on the external and/or internal surface of said hollow body (FIG. 4, 11). Preferably, said container is made of a plastic material, such as, for example, polypropylene, polyethylene, polyurethane or polyvinyl chloride.

The container (10) may be adapted to contain liquid substances. Preferably, said product is a liquid detergent. According to the present invention the liquid detergent may comprise any ingredients known in the art. Such ingredients may include surfactants, suds suppressors, bleaches, chelants, builders, enzymes, fillers and perfumes.

An essential feature of the present invention is a ball (3). Said ball is located partially inside said hollow body (1) at the dispensing opening (2), i.e. said ball protrudes at last partially from said dispensing opening, i.e. said ball is located in the upper portion of said container. The dimensions of said ball and said dispensing opening are tuned to each other so that the ball is not normally able to escape through said dispensing opening to the exterior of said hollow body. In use, the content of said container is spread by said ball, since said ball is always in communication with the content of said container (10). In use, part of the content gets in contact with said ball and is then applied onto a surface outside said container by rotation of said ball.

Said ball (3) may be hollow or solid, and may have a generally smooth outer surface or may have an outer surface having some degree of roughness. Said ball may be made of an open or closed celled structure. Preferably, said ball is rigid. The use of a spherical ball permits an omnidirectional spreading, since a spherical ball will rotate in any direction with equal efficacy, if said spherical ball is not fixed in one axis. Other shapes of said ball may be utilized, such as, for example, cylindrical or ellipsoidal. But such shapes may present functional limitations in that balls of that shapes will only generally rotate about a single axis. Preferably, the present invention uses spherical balls to allow an omnidirectional spreading. We found that this feature is particularly useful to achieve an accurate and comfortable spreading of liquid detergent during pretreatment, regardless of the patterns of stains. On the contrary, if the ball was limited to rotate around one axis, the user would be obliged to perform complicated movements with his hand, like twisting the wrist. The spreading with an omnidirectional rotating ball is also better controlled, and therefore avoids waste of liquid detergent, since it is easier to spread only on the limited area of the stain.

Specifically for dosing and/or dispensing devices, said ball may be preferably made of a material resistant to water temperatures up to 95° C. For example it is possible to use plastic materials, such as, for example, polyethylene, polypropylene, polyurethane, or polyvinyl chloride. The ball (3) is manufactured separately from the hollow body (1). This ball can be then inserted through said dispensing opening into said flexible and resilient support means by simply pushing said ball through the lip (9) of said dispensing opening. This is possible, since said lip (9) of said dispensing opening is flexible enough to be at least slightly elastically deformed, since said lip, part of the hollow body or of the flexible and resilient support means, is preferably made of a plastic material. The container (10) can also comprise more than one ball (3), held separately in different dispensing openings (2) or in a common dispensing opening.

The flexible and resilient support means (4) for said ball is another essential feature of the present invention. Said flexible and resilient support means urges said ball (3) against said dispensing opening (2), achieving a tight engagement between said ball and said dispensing opening. Accordingly, said flexible and resilient support means closes the dispensing opening with the cooperation of said ball and it is located in the upper portion of said container. In a preferred embodiment, said flexible and resilient support means presses said ball against the most external rim or lip (9) of said dispensing opening. We found that the engagement between said opening (2) and said ball urged by said flexible and resilient support means is substantially leak tight for liquids. In the following, "substantially leak-tight" means that said engagement between said ball and said dispensing opening is resistant to product flow when the only force exerting onto said product against said engagement is composed by the hydrostatic pressure. Therefore, it is possible to avoid substantial leakage or spillage during the periods of non-use of said container (10) without the cooperation of a cap.

As a preferred option, said lip (9) of said flexible and resilient support means (4) is flexible or deformable. In this manner, the flexible or deformable lip is able to conform to and/or compensate for any imperfection in the shape of said ball, e.g. when said ball does not have a perfect spherical shape. To achieve this, said flexible or deformable lip may be made of a separate material attached to the perimeter of said dispensing opening. Said flexible or deformable lip of said flexible and resilient support means may also be made by co-injecting a flexible or deformable material, like rubber, forming said lip together with a more rigid material for the rest of said flexible and resilient support means. A flexible or deformable lip does not affect the strength and/or structure of said flexible and resilient support means.

Said flexible and resilient support means (4) is able to be resiliently deformed by an external force acting on said ball (3). Accordingly, by pushing said ball to the inside of said container, said substantially leak-tight engagement between said ball and said dispensing opening (2) is disengaged. Consequently, said ball is free to rotate and able to spread the content, since the free passage between said lip (9) and said ball connects the content with the protruding part of said ball. The free passage between said lip (9) and said ball is hereinafter called "product flow passage". The substantially leak-tight engagement is immediately and automatically re-established once the external force stops to push said ball to the inside of said container. Consequently, the product flow passage is closed interrupting the product flow from inside said container. Said ball urged against said dispensing opening achieves an engagement which makes said container substantially leak-tight when not in use.

The flexible and resilient support means (4) according to the present invention allows to adapt the flow of product from the interior of said container. Indeed, the dimension of the passage between said lip (9) and said ball (3) can be adjusted by the user by varying the external force exerted on said ball. Consequently, the amount of the product flow from the inside of said container can be controlled by varying the dimension of said passage. Specifically, a greater product flow can be achieved by pressing said ball further inside said container. Furthermore, said flexible and resilient support means in combination with a flexible container further allows to dispense or pour directly the product onto a surface by pressing onto said ball and squeezing said flexible container.

FIG. 1*a* shows an embodiment according to the present invention. Said flexible and resilient support means (4) comprises a spring (5) located under said ball (3). Said spring presses said ball (3) against said dispensing opening (2) to achieve said substantially leak-tight engagement during the periods of non-use of said container. By exerting a force F on said ball towards the inside of said container, said spring resiliently deforms and the desired product flow passage is created, as shown in FIG. 1*b*. Said spring may be separately attached or an integral part of said hollow body (1). Furthermore, said spring may be made of any possible material, such as, for example, metal or plastic. Said spring may have any possible shape, such as, for example, helical or cylindrical.

Figure 2A:
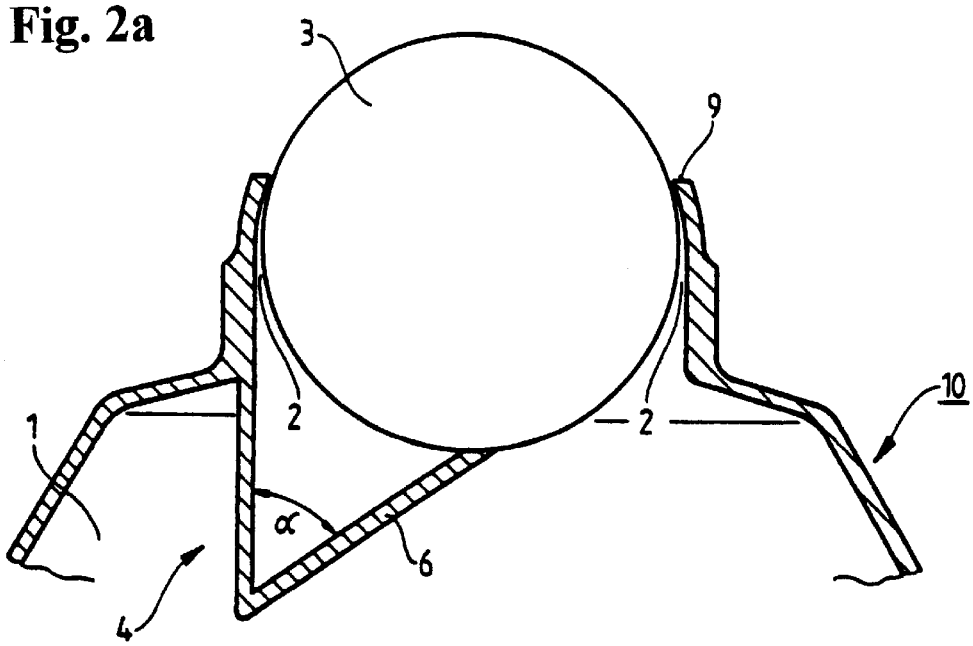
FIGS. 2*a* and 2*b* are cross sectional views showing containers (shown partially) with other embodiments of the flexible and resilient support means for a ball according to the present invention.
Figure 2B:
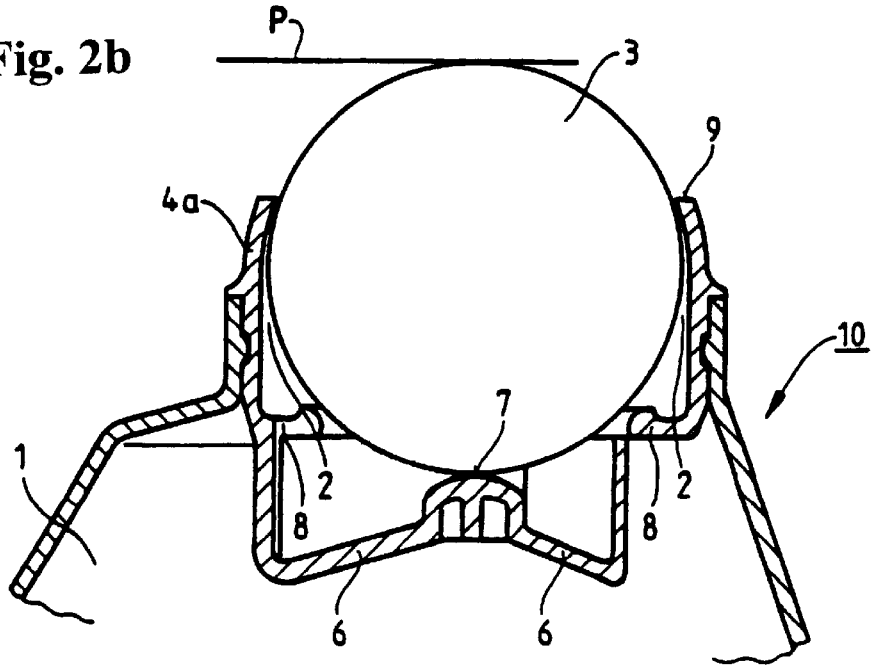

As another preferred embodiment according to the present invention, said flexible and resilient support means comprises in the region opposite said dispensing opening at least a resiliently deformable arm (6) urging said ball against said dispensing opening (2) to achieve said leak-tight engagement. Said arm (6) may be bent at an angle $\alpha$ (FIG. 2*a*) to achieve said resilient deformability. Preferably, $\alpha$ is between 0° deg and 90°0 deg. Preferably, said flexible and resilient support means comprises a housing (4*a*) which fits the container and defines said dispensing opening at one extremity, as illustrated in FIG. 2*b*. The fitment of said housing to said container has to be leak-tight, but said fitment may be threaded or snapped to said container. A threaded fitment of said housing to said container may have the advantage to allow an easy refilling of said container by the user. Therefore, said flexible and resilient support means (4) may be made of a rigid or flexible housing, said housing supporting said spring (5) or said flexible arm (6) and may be inserted into said dispensing opening (2).

As a more preferred embodiment according to the present invention, said flexible and resilient support means (4) may comprise more than one said resiliently deformable arm (6) as in FIG. 2*b*. And as a most preferred embodiment according to the present invention all of said arms are connected together at a ring of contact or single point of contact (FIG. 2*b*, 7) with said ball. Preferably, said single point of contact (7) with said ball is at the point of the ball which is most opposite to said dispensing opening (2).

Figure 3:
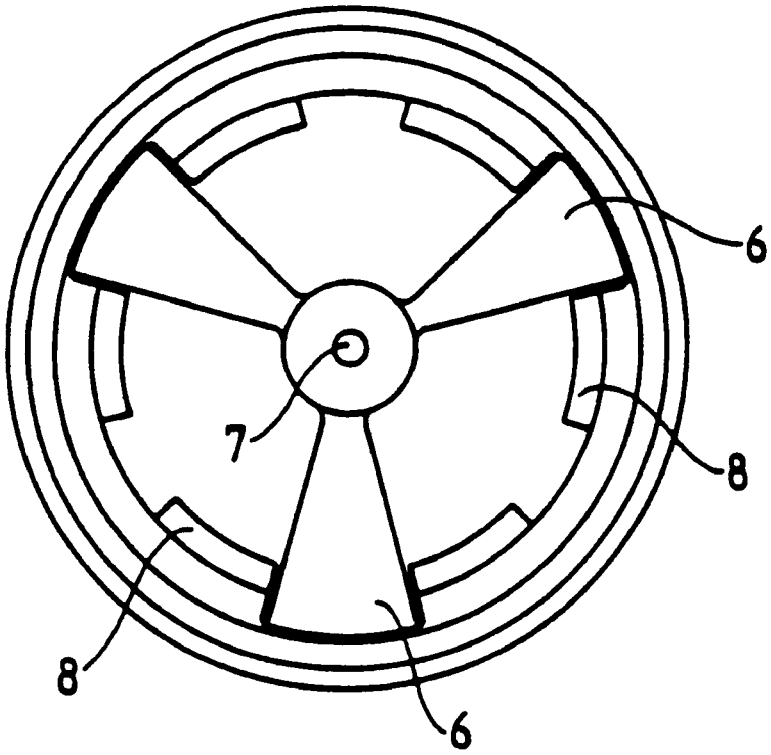
FIG. 3 illustrates the top view of the embodiment of the flexible and resilient support means for the ball of FIG. 2*b*.

As a further preferred option, said flexible and resilient support means (4) may comprise, in its region opposite said dispensing opening (2), an interrupted rim (FIG. 3, 8) against which the ball (3) is urged when an external force is applied. This means that said interrupted rim prevents that said ball from being pushed further inside said container. But because said rim is interrupted, i.e. said rim has at least one permanently open passage for the content, the passage for the product flow is guaranteed. Therefore, said interrupted rim defines the maximum product flow passage allowed by said flexible and resilient support means. Furthermore, said interrupted rim impedes that said ball from being pushed further inwards with the risk to break said spring of said flexible and resilient support means.

Said flexible and resilient support means (4) may be an integral part to or separated part to said container (10). Said flexible and resilient support means may be made of injection resins (like, for example, polypropylene, polyethylene, polyamide, polyoxymethylene) or elastomeric polymers like thermoplastic elastomers (for example, polyurethane rubber, isoprene rubber, styrenebutadiene rubber) or a combination thereof. Furthermore, two or more stage injection of materials may be used to achieve a flexible and resilient support means having, for example, an elastic spring combined with a rigid attachment feature.

Figure 4A:
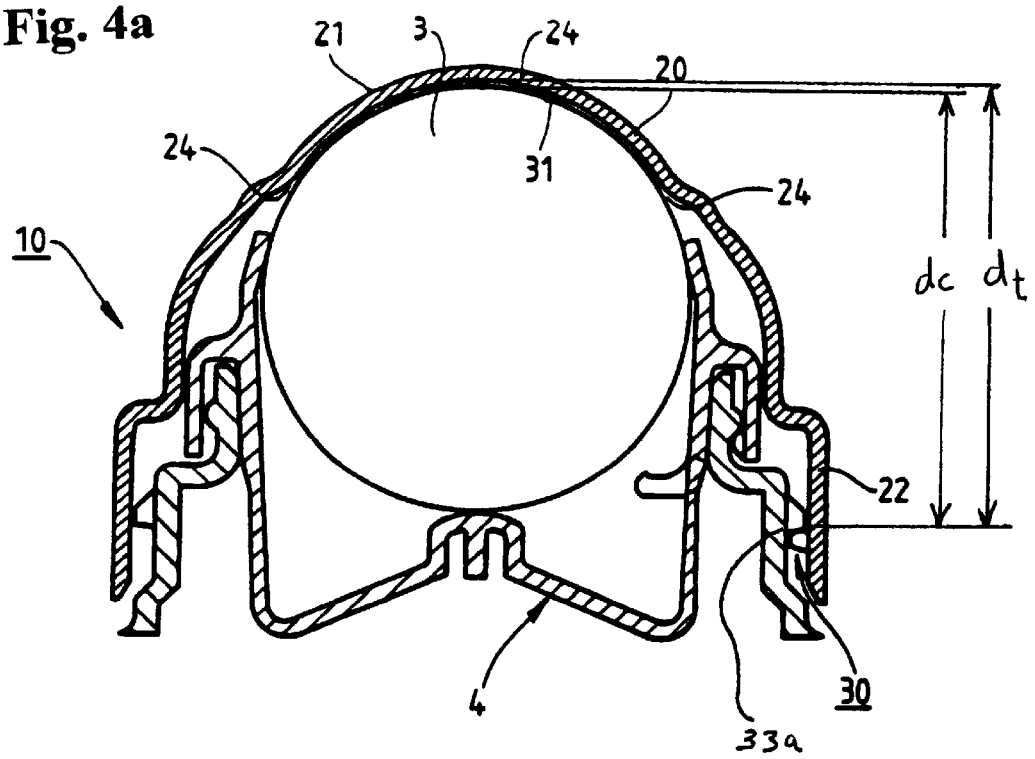
FIGS. 4*a* and 4*b* are cross sectional views illustrating a container (shown partially) comprising a cap. Said cap in FIG. 4*a* is in rest position, i.e. said cap is not pushing onto said ball. On the contrary, FIG. 4*b* being an enlarged view of the upper portion of said container freezes a moment when said cap presses onto said ball.

Said cap (20) is another essential feature of the present invention. FIG. 4*a* illustrates said cap engaged on said container (10). Said cap comprises a top wall (21) and a skirt (22) substantially perpendicular to said top wall. The engagement means (30) which allows said cap to be engaged to said container are part of said skirt. Said container comprises the flexible and resilient support means (4) described above in FIG. 2*b*. Nevertheless, other flexible and resilient support means (4) as described above, for example in FIG. 1*a* and 2*b*, are also possible. Said cap protects said ball against damages when said ball is not in use. Once completely engaged said cap stays in a rest position in which the surface of said cap facing said ball (hereinafter called "underside" of the cap) nowhere touches said ball. Said ball may be further pressed upwards by the pressure built up inside said container until said ball meets and eventually presses onto the underside of said cap. Therefore, said cap may be also helpful to prevent that the pressure built up inside said container ejects said ball outwards from said container. According to the present invention said cap presses onto said ball creating a free passage between said ball and said dispensing opening (as shown in FIG. 1*b*) only when said cap is engaged or disengaged from said container. Saying that said cap is engaged or disengaged means that said cap is moved towards, or away from said rest position.

As said before, said free passage is available when said cap presses onto said ball. This happens when said cap is engaged or disengaged from said container. This means that during this operation said container is held in its upright position and the head space is located in the upper portion of said container over the level of product contained in said container. The "head space" is the volume of gas remaining in said container after the filling between the highest level of said product and the lip (9) of said dispensing opening (2). Consequently, the gases of said head space escape through said free passage without expelling also product. Therefore, said container is vented without creating messiness and waste.

The availability of said free passage is limited over a relatively small period of time. Indeed, this availability is limited to the time necessary to engage or disengage said cap (20) from said container (10). But we found that this period of time is sufficient to release at least a part of the pressure build up inside said container decreasing substantially the pressure difference between the inside and the outside of said container. We further found that the amount of pressure decrease obtained in this manner is sufficient to avoid that product located around said ball is expelled in an uncontrolled manner together with the pressure release. Therefore, messiness and waste of expelled product is substantially avoided. The overpressure existing inside said container is defined as being the difference between the pressure inside said container and the pressure outside said container. The decrease of overpressure achieved when said cap is engaged or disengaged from said container and creates said free passage is at least about 10%, more preferably at least about 50%, most preferably at least about 90%. Specifically, we found that when the pressure built up inside said container is about 250 mbar, it is needed to get this pressure below about 50 mbar to avoid substantial dispensing negatives. Dispensing negatives are principally messiness and waste created when the gas inside said container is expelled during dispensing of the product, like a burp as described above.

Figure 4B:
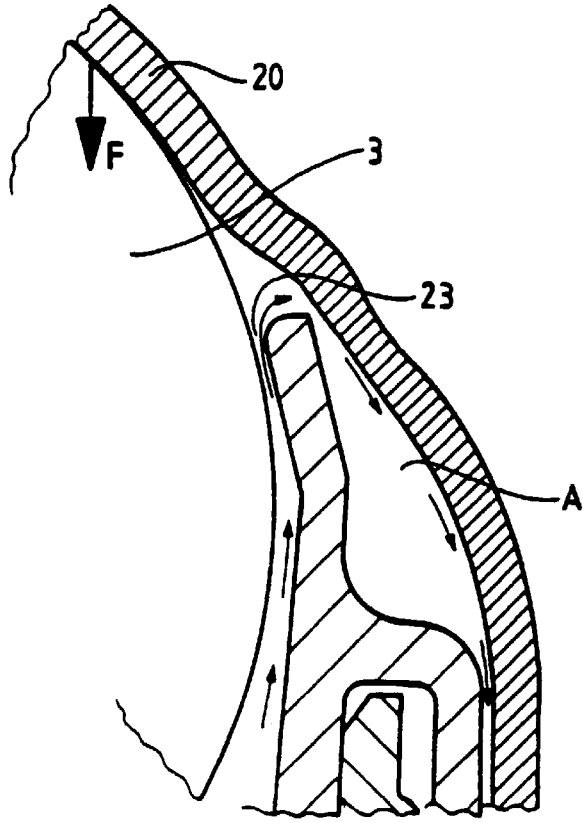

FIG. 4*a* illustrates said cap (20) in the rest position. Said cap nowhere touches said ball (3). Specifically, a gap (24) divides the outer surface of said ball from the inner surface (31) of said cap. Therefore, said ball urged against said dispensing opening (2) closes said dispensing opening in a gas-tight manner. In the following, "gas-tightness" means that no gases are able to pass through the engagement between the inside and the outside of the container. Alternatively, "gas-tightness" may also mean that the rate of pressure which may be released to the outside of the container through this engagement (hereinafter called "pressure release rate") is smaller than the rate of pressure produced inside said container. Therefore, a pressure builds up inside said container, because the amount of gases which are able to escape to the outside of said container is too small in respect to the pressure built up inside said container. FIG. 4*b* shows in an enlarged view the moment in which said cap depresses said ball during disengagement of said cap from said container. The same happens in the reversed situation when said cap is engaged onto said container. This allows a greater flow of gases to pass through said free passage (23) to the outside of said container, as depicted by the arrows, during cap removal.

Figure 4C:
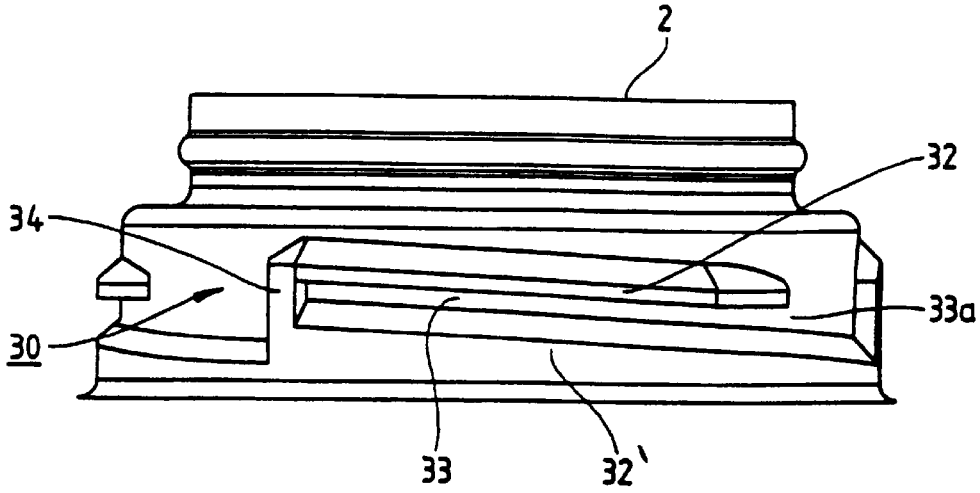
FIGS. 4*c* and 4*d* are front views illustrating the engagement means in the upper portion of said container according to the present invention.

As described before, said cap (20) depresses said ball (3) when said cap is engaged or disengaged from said container (10). A way to achieve this is to provide an engagement means (30) between said cap and said container which guides said top wall of said cap towards said ball to press onto said ball whenever said cap is engaged or disengaged. We found that a possible embodiment is to have said engagement means comprising inclined screw threads (FIG. 4*c*, 30). The threads on the skirt (22) of said cap concur with other threads located on the outer surface of said hollow body (1) under the opening (2). We found that the threads on the outer surface of said hollow body can be inclined in such a manner to bring said top wall of said cap in contact with said ball pressing onto said ball. Said threads may be part of the outer surface of said container or part of the outer surface of said flexible and resilient support means (4).

An example is shown in FIG. 4*c*. Said thread comprises two ribs (32, 32') delimiting in their middle a channel (33). Said channel is dimensioned to fully accommodate the corresponding thread on said cap. Said channel is open at one end (33*a*) and closed at the opposite end by a wall (34). Preferably, said wall (34) connects said two ribs (32, 32') together. Therefore, to engage said cap to said container, the thread of said cap has to enter the channel from its open end. The open end of said channel (33) is in a lower position in respect to the closed end when said container stands on its upright position. This means that said cap has to be pressed down until its threads are able to enter into said channel.

Figure 4D:
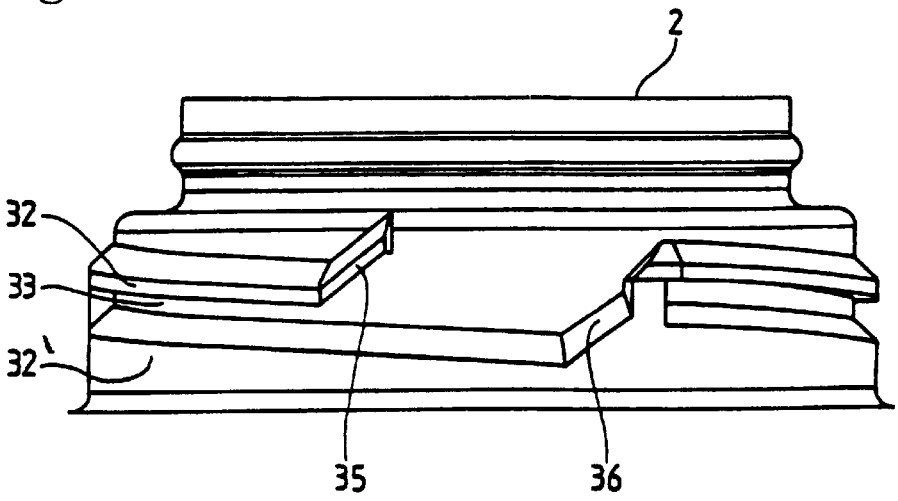

As a preferred option, the rib (32) above said channel (33) nearest to said opening (2) further comprises an inclined portion (35). The inclination of said inclined portion is directed towards said opening (2), as illustrated in FIG. 4*d*. This facilitates especially the engagement into said channel (33) of the threads of said cap. Indeed, said inclined portion (35) guides the thread of said cap (20) back into said channel when reclosing said container. Consequently, it is easy to use rotational movement to engage said cap (20) with said engagement means (30) without having to push down said cap. As another preferred option, the rib (32') under said channel (33) further away from said opening may further comprise a second inclined portion (36). Again, the inclination of said second inclined portion is also directed towards said opening (2), as illustrated in FIG. 4*d*. This second inclined portion (36) facilitates especially the disengagement from said channel (33) of the threads of said cap. Indeed, said inclined portion (36) forces said cap upwards helping in lifting up said cap when disengaging said cap from said container.

In the following, the plane (P, FIG. 4*a*) is the plane tangent to the highest point of said ball when said container stands in its upright position. Furthermore, $d_t$ is the distance between said open end (FIG 4*c*, 33*a*) and said top wall (FIG. 4*a*, 31) on the underside of said cap, and $d_c$ is the distance between said open end (FIG. 4*c*, 33*a*) and said plane (P). Consequently, when the distance $d_t$ is smaller than the distance $d_c$, said top wall presses onto said ball when the thread of said cap enters into said open end of said channel. The difference $\Delta=(d_c-d_t)$ can be less or equal to the maximum displacement of said ball inside said container allowed by said flexible and resilient support means. Said cap is then further turned to the left until the thread of said cap is stopped by said wall (FIG. 4*c*, 34). In this position said cap closes said container. Said cap presses onto said ball also when it is disengaged from said container. Indeed, turning said cap to the right, said cap moves from the closed end to said open end of said channel, i.e. said cap is downwardly displaced going from said closed end to said open end. Therefore, said cap is able again to press onto said ball and to open said free passage (23) between the interior and the exterior of said container.

Figure 6:
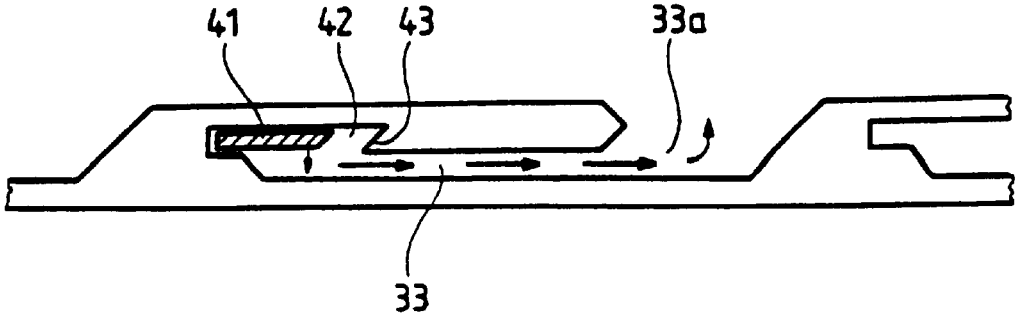
FIG. 6 is a front view of the engagement between the cap and the container, whereby said engagement is a child resistant closure.

Said cap (20) comprising child resistant features is another possibility to achieve a free passage (23) when said cap is engaged and/or disengaged from said container. An example is shown in FIG. 6. In this case, the thread (41) of said cap has to be pushed down first into said channel (33) from the space (42) to get said thread (41) of said cap to the open end (33*a*), and to separate said cap from said engagement with said container. In case said thread (41) of said cap is turned without being pushed down, said thread (41) is impeded to further turn by the wall (43).

In the following, a "gas-tight cap" is intended to be a cap which substantially prevents any venting of gases to the outside of said container. In case said cap (20) is not gas-tight, the gases passing through said free passage are directly vented to the external atmosphere, e.g. through the area of the screw threads. To facilitate the flow of gases to the outside of said container, preferably said cap may be provided with at least one orifice. Said orifice is a hole made through the thickness of said cap. The situation is different when said cap (20) closes said container (10) in a gas-tight manner. In this case, possible escape ways for the gases coming through said free passage (23) have to be foreseen. Preferably, said gas-tight cap may be useful when said engagement between said ball (3) and said opening (2) allows a small pressure release rate. Indeed, we found that the gases which pass through the engagement between said ball and said opening may also force outwards a certain quantity of the contained liquid product. Therefore said gas-tight cap avoids messiness and waste.

The simplest way is to let said gases first escape within any free volumes (FIG. 4*b*, A) existing between said cap and said container. Afterwards, these gases in volumes (FIG. 4*b*, A) can be completely released after said cap is completely disengaged. This is not an ideal solution when the volumes (FIG. 4*b*, A) do not provide enough space for the gases coming from within said container.

Figure 5A:
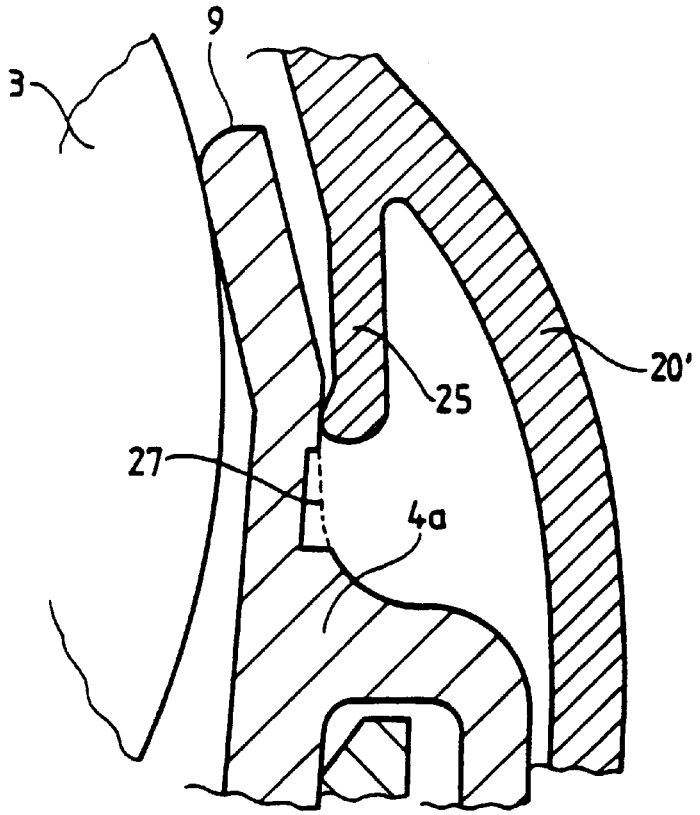
FIGS. 5*a*, 5*b* and 5*c* are equivalent to the corresponding FIGS. 4*a* and 4*b*, whereby said cap is shown in another embodiment according to the present invention.
Figure 5B:
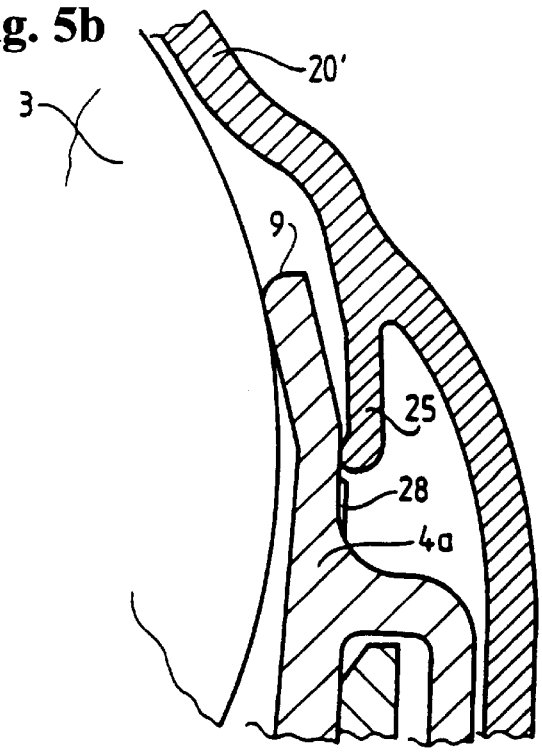

Another gas-tight cap (20') is shown, for example, in FIGS. 5*a* and 5*b*. Preferably, said cap (20') further comprises a sealing ring (25). Said sealing ring is a continuous wall extending from the inner surface of said top wall (21) and being substantially parallel to said skirt (22). Said sealing ring completely surrounds the outer surface of said hollow body (1) in the upper portion of said container. Preferably, said sealing ring surrounds the outer surface of said hollow body right under said lip (9). More preferably, said sealing ring surrounds the outer surface of said housing (4*a*) right under said lip (9). Said sealing ring achieves a leak tight connection with the outer surface of said hollow body when said cap is in said rest position. As described above, said cap moves downward pressing on said ball when said is disengaged. In this manner, said sealing ring may by pushed down onto a location of said outer surface of said hollow body where said sealing ring does not achieve a gas-tight engagement anymore. Consequently, said gases venting through said free passage (23) may eventually escape to the exterior of said container. This venting may be facilitated with at least an orifice located below said sealing ring when said container stands on its upright position.

An embodiment achieving the venting mechanism described before is shown in FIG. 5*a*. The upper portion of said container further comprises at least a recess (27). Said recess is located on the outer surface of said hollow body (1) under said sealing ring (25) of said cap (20') when said cap closes said container in its rest position. Said recess may be a continuous channel all around said outer surface of said hollow body. It is also feasible to have more than one recess around said outer surface of said hollow body separated from each other. Preferably, all recesses are located on the same height. Said recess may be formed by reducing the thickness between the inner and the outer surface of said hollow body. Alternatively, said recess may be a concave bent portion of the wall of said hollow body when seen from the exterior of said container.

Said recess (27) allows the gases escaping from the interior of said container to vent to the outside of said container. Indeed, when said cap (20') is disengaged from said container, said sealing ring is pushed downwards towards said recess. And once onto said recess, said sealing ring does no longer ensure a gas-tight engagement with the upper portion of said container, i.e. there is a gap of free space between said recess and said sealing ring. Consequently, the gases passing through said free passage (23) when said ball is pressed down by said cap escape through this gap between said recess and said sealing ring to the outside of said container. The same happens when said cap is engaged onto said container.

Another possible embodiment which achieves the same venting mechanism as described in FIG. 5*a* is illustrated in FIG. 5*b*. In this case said recess (27) is substituted by at least a protrusion (28). This means that said protrusion (28) is located on the outer surface of said hollow body (1) under said sealing ring (25) of said cap (20') when said cap closes said container in its rest position. It is again feasible to have more than one protrusion around said outer surface of said hollow body independent from each other. Preferably, all protrusions are located on the same height. Said protrusions are not connected to each other. Otherwise no passage for the venting of gases would be available. Said protrusion may be formed by increasing the thickness between the inner and the outer surface of said hollow body. Alternatively, said protrusion may be a convex bent portion of the wall of said hollow body when seen from the exterior of said container.

Figure 5C:
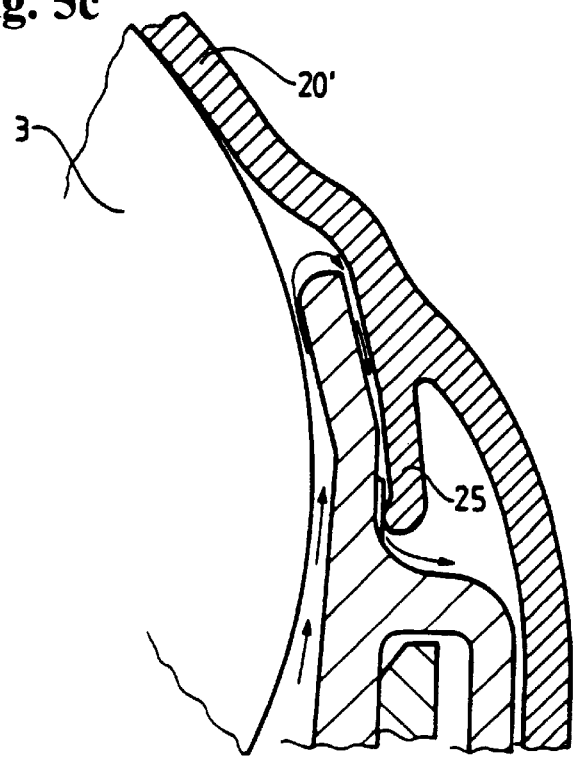

As before for said recess (27), said protrusion (28) allows the gases escaping from the interior of said container to vent to the outside of said container. Indeed, when said cap (20') is disengaged from said container, said sealing ring is pushed downwards towards said protrusion. And once onto said protrusion, said sealing ring does no longer ensure a gas-tight engagement with the upper portion of said container, i.e. there is a gap of free space between said sealing ring and immediately around said protrusion. Indeed, said sealing ring is at least partially elevated by said protrusion, as depicted in FIG. 5*c*. When more than one of said protrusions are present said sealing ring may be completely elevated, whereby the gases escaping from the inside of said container vent through the free space between said separated protrusions. Consequently, the gases passing through said free passage (23) when said ball is pressed down by said cap escape through this free space between said protrusion and said sealing ring to the outside of said container. The same happens when said cap is engaged onto said container.

What is claimed is:

1. A container (10) adapted to contain and dispense a product, said container comprising a hollow body (1), a dispensing opening (2), a ball (3), and a flexible, resilient support means (4) for said ball and a cap (20), said flexible and resilient support means urging said ball against said dispensing opening, achieving a substantially leak tight engagement between said ball and said dispensing opening, and said flexible and resilient support means can be resiliently deformed by an external force acting on said ball whereby said substantially leak tight engagement between said ball and said dispensing opening is disengaged, allowing said contained product to be spread by said ball, said cap can be engaged to said container in a removable manner, said cap covering said ball, characterized in that said cap presses onto said ball creating a free passage (23) between said ball and said dispensing opening only when said cap is engaged and disengaged from said container, said container comprises an engagement means (30) between said cap and said container which guides a top wall of said cap towards said ball to press onto said ball whenever said cap is engaged and disengaged, said engagement means (30) comprises inclined screw threads (30) on the outer surface of said hollow body (1), said screw threads (130) comprising at least two ribs (32,32') delimiting in middle of said ribs a channel (33), said channel being dimensioned to fully accommodate a corresponding thread on said cap, said channel is open at one end (33*a*) and closed at the opposite end by a wall (34), said open end of said channel (33) is in a lower position with respect to the closed end when said container stands on its upright position.

2. A container according to claim 1 characterized in that said wall (34) connects said two ribs (32,32') together.

3. A container according to claim 1 characterized in that said ribs (32, 32') further comprise each an inclined portion (35 and 36).

4. A container according to claim 1 characterized in that said cap (20') comprises a sealing ring (25).

5. A container according to claim 4 characterized in that said container comprises at least a recess (27) or a rib (28), said recess or said rib being located on the outer surface of said hollow body (1) or said housing (4*a*) under a lip (9) and under-said sealing ring (25) of said cap (20') when said cap closes said container in its rest positioned.

6. A container according to claim 5 characterized in that the lip (9) of said dispensing opening is deformable.

7. A container according to claim 1 characterized in that said flexible and resilient support means (4) comprises a housing which fits the container and defines said dispensing opening at one extremity, said housing comprising in the region of the opposite extremity to said dispensing opening a spring (5) located under said ball (3), said spring pressing said ball (3) against said dispensing opening (2) to achieve said leak-tight engagement during the periods of non-use of said container.

8. A container according to claim 7 characterized in that said housing comprises, in the region opposite to said dispensing opening (2) an interrupted rim (8) against which the ball (3) is urged when an external force is applied.

9. A container according to claim 1 characterized in that said flexible and resilient support means is made of a material selected from the group consisting of: injected resins, elastomeric polymers and a combination thereof.

10. A container according to claim 1 characterized in that said container is made of a rigid or flexible material.

11. A container according to claim 1 characterized in that said container can be a bottle or a tube.

12. A container according to claim 1 characterized in that an upper portion of said container is inclined with respect to the axis of said container.

13. A container according to claim 1 characterized in that said ball (3) is spherically shaped.

* * * * *